US012503859B2

(12) United States Patent
Dawson

(10) Patent No.: US 12,503,859 B2
(45) Date of Patent: Dec. 23, 2025

(54) FLASHING SYSTEM

(71) Applicant: Jesse Lee Dawson, Clearwater, FL (US)

(72) Inventor: Jesse Lee Dawson, Clearwater, FL (US)

( * ) Notice: Subject to any disclaimer, the term of this patent is extended or adjusted under 35 U.S.C. 154(b) by 179 days.

(21) Appl. No.: 18/398,470

(22) Filed: Dec. 28, 2023

(65) Prior Publication Data

US 2024/0401339 A1 Dec. 5, 2024

Related U.S. Application Data

(60) Provisional application No. 63/471,131, filed on Jun. 5, 2023.

(51) Int. Cl.
*E04D 13/15* (2006.01)
*E04B 1/68* (2006.01)

(52) U.S. Cl.
CPC ..... *E04D 13/15* (2013.01); *E04B 1/6803* (2013.01); *E04B 1/6806* (2013.01)

(58) Field of Classification Search
CPC ..... E04D 13/15; E04B 1/6803; E04B 1/6806
USPC ..... 52/58
See application file for complete search history.

(56) References Cited

U.S. PATENT DOCUMENTS 1,924,008 A 8/1933 Weil
1,958,622 A 5/1934 Herman
2,168,204 A 8/1939 Hanson
RE24,027 E * 6/1955 Bourne et al. ..... E06B 1/6053 52/97
2,807,222 A 9/1957 Fry
2,995,870 A 8/1961 O'Hanlon, Jr.
3,090,161 A 5/1963 Edwards
3,241,271 A 3/1966 Berg
4,156,993 A * 6/1979 Sorrells, Jr. ..... E04D 13/1415 52/60
4,190,989 A * 3/1980 Sakharoff ..... E04D 13/1415 52/60
5,123,208 A 6/1992 Kirby et al.
5,357,720 A 10/1994 O'Keeffe et al.
5,519,969 A 5/1996 Golba
5,553,425 A * 9/1996 Sampson ..... E04D 13/0315 52/745.15
5,927,023 A * 7/1999 Kittilstad ..... E04D 13/155 52/716.2
6,108,981 A * 8/2000 Sama ..... E04D 13/1415 52/60

(Continued)

*Primary Examiner* — Paola Agudelo
(74) *Attorney, Agent, or Firm* — Dinsmore & Shohl LLP

(57) ABSTRACT

A flashing system includes a one-piece reglet and a one-piece counterflashing. The reglet has a cross-section including a central shaft with a C-shaped channel at its first end forming a sealant pocket and an L-shaped portion formed at its second end having a stem extending perpendicularly in the same direction as a leg of the C-shaped channel. A receiver descends parallel to the central shaft from a stem of the C-shaped channel. The counterflashing has a cross-section including a central bar having a right angle at each end with a first wall extending from the first right angle and a second wall extending from the second right angle. The counterflashing engages the reglet. The first wall has a tip bent at an acute angle to form a top clip. The second wall a tip bent at an obtuse angle to form a drip edge.

10 Claims, 4 Drawing Sheets

(56) References Cited

U.S. PATENT DOCUMENTS

| | | | | |
|---|---|---|---|---|
| 6,293,064 | B1 * | 9/2001 | Larson | E04F 13/068 52/302.1 |
| 6,883,288 | B1 * | 4/2005 | Harbin | E04F 19/02 52/522 |
| 7,676,996 | B2 * | 3/2010 | Teodorovich | E06B 1/62 52/60 |
| 8,061,086 | B2 | 11/2011 | Haun | |
| 8,959,842 | B2 * | 2/2015 | Norwood | E04B 1/66 52/60 |
| 9,356,174 | B2 | 5/2016 | Duarte et al. | |
| 10,214,909 | B1 | 2/2019 | Bregenzer | |
| 10,519,709 | B2 | 12/2019 | Ugliuzza | |
| 10,900,221 | B2 | 1/2021 | McEndree et al. | |
| 10,968,635 | B1 * | 4/2021 | Duran | E04D 3/363 |
| 2004/0148871 | A1 | 8/2004 | Fandel | |
| 2005/0086873 | A1 | 4/2005 | Mares | |
| 2008/0196351 | A1 | 8/2008 | Seth | |
| 2012/0151870 | A1 * | 6/2012 | Summy | E04F 21/0038 493/344 |
| 2018/0038096 | A1 * | 2/2018 | Kadavy | E04B 1/70 |

* cited by examiner

FLASHING SYSTEM

CROSS-REFERENCE TO RELATED APPLICATION

This application claims the benefit of priority of U.S. provisional application No. 63/471,131, filed Jun. 5, 2023, the contents of which are herein incorporated by reference.

BACKGROUND OF THE INVENTION

The present invention relates to flashing used in building construction and, more particularly, to a flashing system.

All types of building have overhangs, balconies, eyebrows, and other features which require a means of protection from water intrusion for the edge joint. Preventing water from getting behind stucco and other cladding systems saves money and prolongs the life of the structure and finishes. Flashing the edge of slabs, balconies and structural eyebrows is intended to make them watertight with minimal maintenance. Balconies and overhangs require a transition over the top of the slab face to prevent water intrusion into the finishes and building structure. Concrete is not perfectly flat or even like a metal flashing, so the flashing will not sit completely flat on the concrete surface. When flashing is installed over concrete, the differences in the tolerance between a straight piece of flashing and an irregular concrete surface causes an "oil canning" effect to occur, which makes sealing between the two materials difficult and causes more areas for water infiltration.

Existing flashing systems are attached to the top of an overhang, balcony, eyebrow, or other feature, generally after the concrete is placed, and require the flashing to be secured to the structure with either exposed sealants or anchors that penetrate the structure and are exposed to the elements. The exposed anchors must be sealed to prevent future water intrusion. They leave exposed sealants as the primary means of waterproofing the joint. They do not provide a clean and neat appearance when installed. Exposed sealants require regular and expensive maintenance. When the systems fail, the stucco or other finish of the building is damaged and may fall off.

The other option with current systems is mounting the flashing or stop to the face of the overhang, balcony, eyebrow, or other feature, which relies solely on an exposed caulk joint at the top of the transition to prevent water intrusion into the building envelope. The currently available systems require sealants to be placed in locations that are exposed to the elements, which causes rapid deterioration of the sealants and leads to expensive and frequent repairs to the waterproofing system.

When existing buildings are being remodeled or require repairs to the waterproofing at overhangs, balconies, eyebrows, and other features, the current systems are limited to the same types of install as new construction, with the same limited life and ability to seal the system and maintain the water tightness of the transition from the waterproofing to the finish of the slab edge.

As can be seen, there is a need for a watertight flashing system for integration into the construction of a slab that does not rely on exposed sealants or penetrative fasteners, does not require excessive maintenance, and is pleasant in appearance.

SUMMARY OF THE INVENTION

In one aspect of the present invention, a flashing system comprises a unitary reglet having a cross-section including a central shaft with a substantially C-shaped channel formed at a first end thereof, having a leg extending in a first direction perpendicular to the central shaft, the substantially C-shaped channel forming a sealant pocket, and having a receiver descending parallel to the central shaft from a stem of the substantially C-shaped channel, and a first L-shaped portion formed at a second end of the central shaft, having a first stem extending perpendicularly therefrom in the first direction; and a unitary counterflashing having a cross-section including: a central bar having a first right angle at a first end thereof and a second right angle opposite the first right angle at a second end thereof, a first wall extending from the first right angle with a tip bent at an acute angle to form a top clip, and a second wall extending from the second right angle with a tip bent at an obtuse angle to form a drip edge; wherein the unitary counterflashing is operative to engage the unitary reglet.

These and other features, aspects and advantages of the present invention will become better understood with reference to the following drawings, description, and claims.

DETAILED DESCRIPTION OF THE INVENTION

Figure 1:
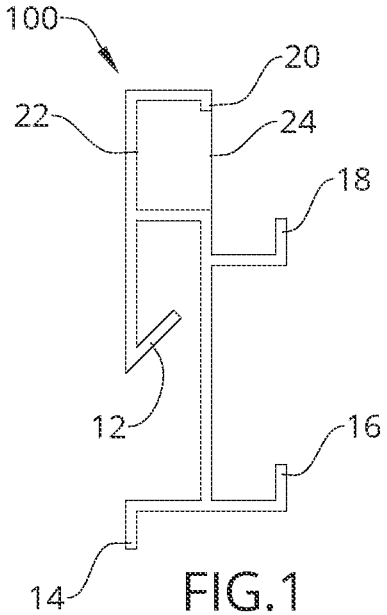
FIG. 1 is a side view of a reglet component of a flashing system according to an embodiment of the present invention.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, one embodiment of the present invention is a flashing system comprising flashing or counterflashing retained in an extrusion or a reglet with integral sealant that may be placed in a form prior to pouring the concrete structure.

The reglet or extrusion, whether embedded or installed post construction, may be fabricated by any suitable means known in the art. The reglet may be formed by extrusion molding in some cases and is therefore sometimes called an "extrusion" herein. Extrusions are used in all types of window and railing systems. The extrusions may be any suitable length to form complete edge assemblies.

The embedded extrusion may be set into the concrete when it is poured, resulting in no conflict in tolerances between the flashing and the concrete that causes "oil canning" of the flashing.

Snap in flashings, end caps, pre-made outside corners, and pre-made inside corners are generally made of sheet metal.

In some embodiments, the components of the flashing system disclosed herein may be manufactured of metal or a polymer. The metal may be selected to be resistant to degradation when embedded in concrete, such as certain grades of stainless steel, or may be coated with a protective material that prevents degradation, such as coated aluminum. The polymer may be any suitable polymeric material that exhibits chemical resistance and durability, such as polyvinyl chloride (PVC).

An extrusion may be placed into a concrete form prior to concrete placement and has an integral waterproofing material which creates a seal between the concrete and the flashing. It also allows the flashing to be installed without drilling any holes or installing fasteners which may be exposed and or may require exposed sealant used to protect fasteners installed after the structure is poured. Thus, the system eliminates the need for frequent maintenance a traditional flashing system requires. The reglet embedded in the concrete, containing a pre-installed sealant such as bituminous water stop, provides a leak proof, watertight edge of slab construction joint. The embedded extrusion provides a square and even edge of slab. The bituminous water stop provides long lasting protection against water infiltration at the top of the deck. When installed post-construction, the extrusion also provides protection against water infiltration at the fastener at a top of the extrusion.

The extrusion, whether embedded or installed post-construction, accommodates snap-in flashing. The flashing is installed with minimal exposed sealants which otherwise require frequent and expensive maintenance. The use of this system will reduce lawsuits and costs for reworking systems due to failed flashings and/or lack of maintenance on flashing and sealants. The system provides a watertight connection to the building with minimal exposed sealants. The system also provides a smooth surface for the waterproofing system on top of a deck to be installed, which prevents water build up and reduced drainage of the balcony or slab edge. The system provides a clean look (e.g., to balcony edges, etc., intersecting with the walls or structure of the building) that is aesthetically pleasing and requires little to no maintenance over the life of the building on which it is installed.

The unique method in which this system's flashing is installed allows nearly all the sealant to be protected from the elements. The unique design of the extrusion and flashing enable installation of the flashing immediately after the finish of the slab edge is completed.

The reglet may alternatively be installed after concrete has been placed, such as for a remodel or remediation job remodeling or repairing flashing systems which have failed on previously constructed buildings, keeping the fasteners sealed without exposed sealants. The extrusion can be attached to the face of the slab edge using fasteners installed into the existing construction. The pocket of the extrusion has sealant pre-installed to seal any top penetrations that attach the extrusion to an existing structure. The pocket protects the sealant from the elements by nature of its shape and location of attachment. The lower fastener of the system installed on previously constructed structures is protected from the elements by the flashing clipped into the extrusion.

Pre-made outside corners and pre-made inside corners provide protection at the outer and inner corners of a slab edge which are much more reliable than field installed applications. In some embodiments, outside corners and inside corners may be fabricated on site.

Referring to FIGS. 1 through 9, FIG. 1 illustrates an embeddable extrusion or reglet 100, a receiver 12, a bottom leg 14, a lower anchor 16, an upper anchor 18, and a top pocket return 20. A pocket 22 formed at the top of the extrusion may be filled with bituminous water stop 24 or any other suitable sealant known in the art. In cross section, the unitary reglet 100 has a central shaft with a substantially "C" shaped portion 22 formed at a first end of the central shaft and a perpendicular bar formed at a second end. The "C" shaped portion 22 generally has right angles. The perpendicular bar extends to form a first "L" shaped portion 16 at a first end and a second "L" shaped portion 14 at a second end, the second "L" shaped portion 14 being rotated 180° from the first "L" shaped portion 16, such that stems of the "L" shapes 14, 16 are joined and legs of the "L" shapes 14, 16 are spaced from the central shaft. A third "L" shaped portion 18 extends normal to the central shaft, parallel to and spaced from the first "L" shaped portion 16. A protrusion 12 descends from a stem of the "C" shaped portion 22, parallel to the central shaft, with a length of about half the length of the central shaft, with an end which is bent at an acute angle into an area between the protrusion 12 and the central shaft.

The anchors 16 and 18 are not limited to the "L" shaped configuration shown in the Figures and may have another configuration, such as exhibiting a bend upward from horizontal between 0° and 90°, such as an angle of about 45°.

The pocket 22 with bituminous water stop 24 is not limited to the position shown in the Figures above the protrusion 12 and "L" shaped portion 14. In some embodiments, the pocket 22 with bituminous water stop 24 may be formed above the position of the anchors 16, 18, leaving an open cavity between the protrusion 12 and the top horizontal surface. In some cases, the lower horizontal wall of the pocket 22 may be formed by the upper anchor 18. The displaced pocket 22 may be advantageous, for example, for use with a post tension slab in which the reglet has a maximum height limit to prevent conflict with the post tension anchors, such as 1½".

In some embodiments, the lower anchor 16 and the upper anchor 18 may be absent, enabling use on a pre-existing structure.

In some embodiments, the "C" shaped portion 22 may have a dividing wall (not shown) extending through a counter of the "C" shape, dividing the "C" shape into two mirror image chambers.

Figure 2:
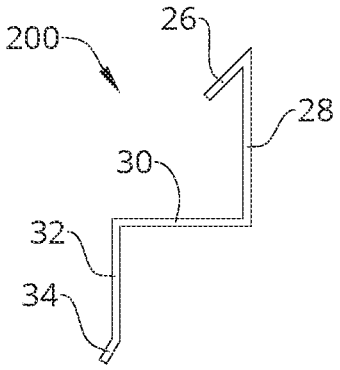
FIG. 2 is a side elevation view of a counterflashing component of the flashing system of FIG. 1.

A snap-in flashing body or counterflashing 200 is shown in FIG. 2 with a top clip 26, a vertical top side 28, a horizontal seat 30, a vertical bottom side 32, and a drip edge 34. In cross-section, the unitary counterflashing 200 has a central bar 30 having a first right angle at a first end thereof and a second right angle at a second end thereof. Extending from the first right angle, a leg 32 having a bent tip with an obtuse angle forms the drip edge 34. A wall 28 extending from the second right angle has a tip 26 bent at an acute angle.

Generally, at least one of the receiver 12 and the top clip 26 is pliable and resilient, allowing the counterflashing 200 to snap into the reglet 100.

Figure 3:
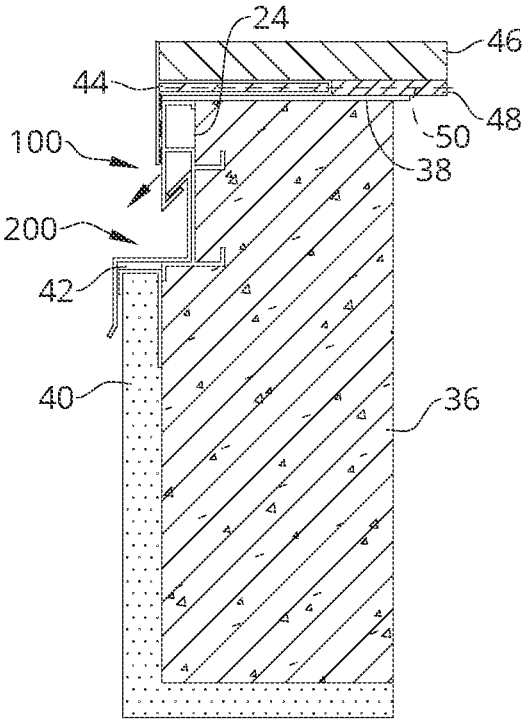
FIG. 3 is a schematic side view of the reglet of FIG. 1 and the counterflashing of FIG. 2, shown in use.

As shown in FIG. 3, the reglet 100 may be embedded into the concrete 36 of a balcony slab. The extrusion or reglet 100 is secured to the concrete 36 by the upper anchor 18 and the lower anchor 16 when the concrete 36 is placed. The bituminous water stop 24 in the pocket 22 is in direct contact with the concrete 36. The top pocket return 20 of the reglet 100 forms the top edge of the slab edge and a termination point for a waterproofing system on top of deck 38. The concrete slab 36 is shown with tile 46 adhered over the waterproofing system to a top of deck 38 with thin set 48. Weep bead 44 is positioned below the tile. Stucco J bead (not shown) and stucco 40 are installed onto the face and underside of the concrete 36. After the stucco 40 installation is complete, sealant 42 is installed on top of the stucco J Bead (and/or weep bead) prior to installing the counterflashing 200. The flashing top clip 26 is inserted upward into the region between the central shaft and the receiver 12, and then pushed down until the flashing horizontal seat 30 is fully embedded into the sealant. The counterflashing 200 is thus snugly coupled to the reglet 100. The flashing vertical bottom side 32 and flashing drip edge 34 hang down over the top of the stucco 40. A water drainage route 50 is shown schematically in FIG. 3.

Figure 4:
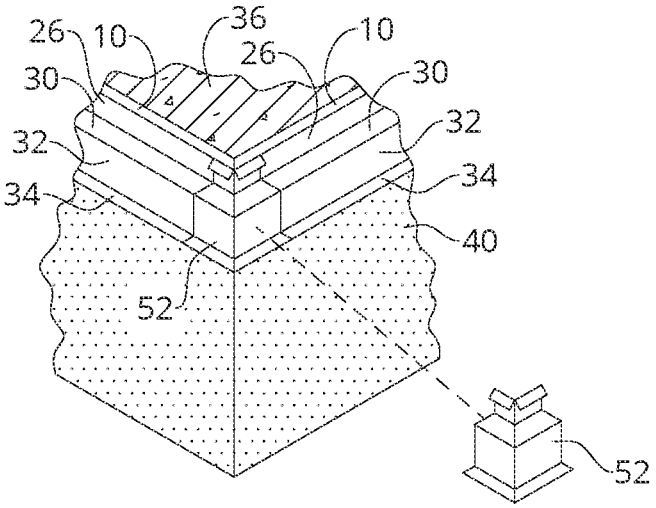
FIG. 4 is a perspective view thereof illustrating installation of a prefabricated outside corner cap component thereof.

As shown in FIG. 4, a pre-made outside corner cap 52 having a clip formed on both sides of its top edge may be installed over the reglet 100 and snap in flashing 200, including a top clip 26, horizontal seat 30, vertical bottom side 32, and drip edge 34. The cap 52 generally conforms to the configuration of the coupled counterflashing 200 and reglet 100. As in FIG. 3, the reglet 100 of FIG. 4 is embedded in concrete 36, which has a veneer of stucco 40. The pre-made outside corner cap 52 and the snap in flashing 200 have a full bed of sealant installed therebetween.

Figure 5:
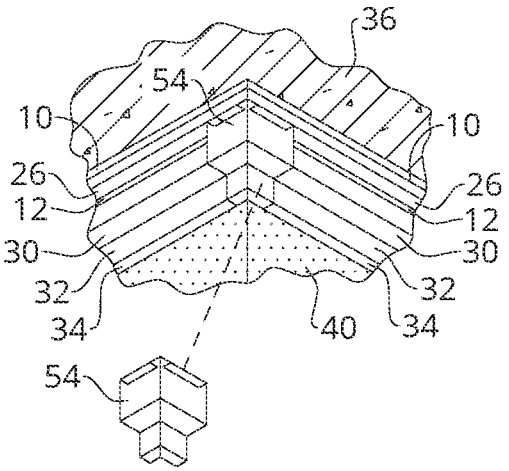
FIG. 5 is another perspective view thereof, illustrating installation of a prefabricated inside corner cap component thereof.

A pre-made inside corner 54, shown in FIG. 5, has a clip on both sides of its top edge. The snap in flashing 200 having a top clip 26 is installed first over stucco 40, as shown in FIG. 3. A full bed of sealant is installed between the pre-made inside corner 54 and the snap in flashing 200. The pre-made inside corner 54 generally conforms to the coupled counterflashing 200 and reglet 100.

Figure 6:
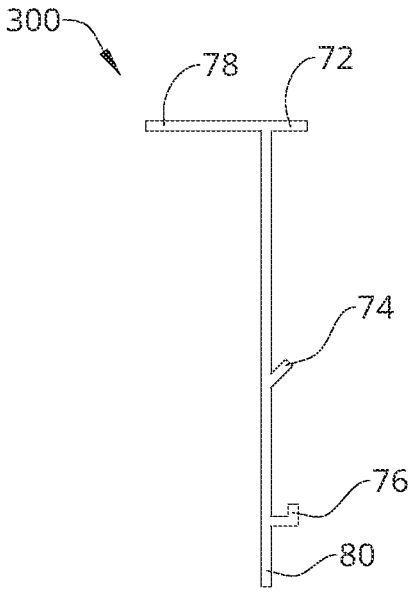
FIG. 6 is a side view of a form clip component thereof.

FIG. 6 is a side view of an extrusion form clip body 300 with a top pocket clip 72, a receiver clip 74, and a bottom leg clip 76. A top form board nailer 78 and a bottom form board nailer 80 are used to secure the extrusion form clip 300 to the form 56 using fasteners (not shown). For example, nails may be driven through the horizontal surface of the top nailer 78 into the form 56 and nails may be driven through the vertical surface of the bottom nailer 80 into the form 56, holding the reglet 100 in position while concrete is poured. In cross-section, the unitary form clip 300 has an asymmetric "T" shape, having a stem 80, and two arms 78, 72, with arm 78 being longer than arm 72. An "L" shaped portion 76 extends from the stem 80 distal from the arms 78, 72. Approximately midway along the length of the stem 80, a leg 74 extends at an acute angle with respect to the portion of the stem 80 proximal to the arm 72. The arm 72, the leg 74, and the "L" shaped portion 76 protrude from one side of the stem 80.

Figure 7:
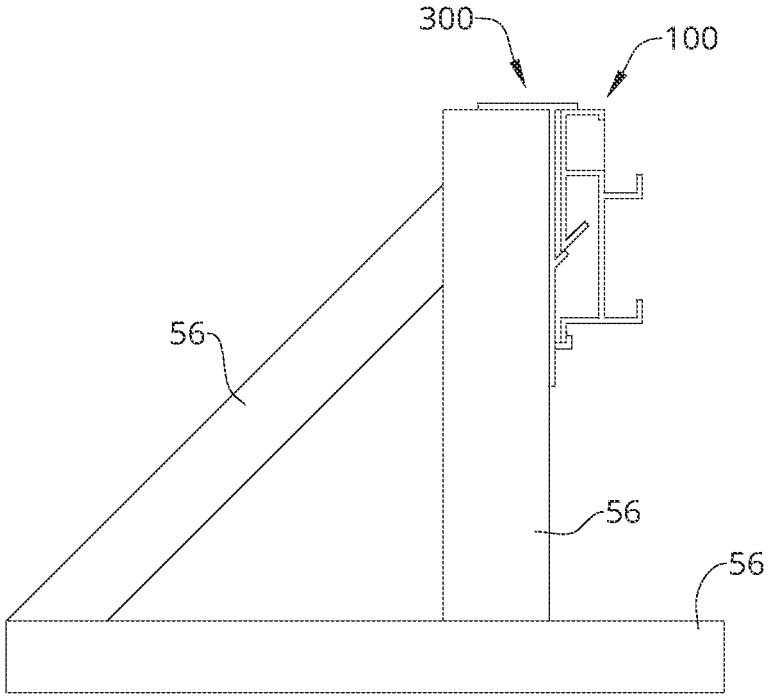
FIG. 7 is a schematic side view of the reglet component and the form clip component thereof, shown in use.

FIG. 7 is a side view of a concrete form 56, comprising boards, with an extrusion form clip 300 attached thereto with fasteners (not shown). An extrusion or reglet 100 is clipped into the extrusion form clip 300. The top pocket clip 72 holds the top pocket return 20, the receiver clip 74 secures the receiver 12, and the bottom leg clip 76 secures the bottom leg 14. The extrusion form clip 300 is used to hold the extrusion 100 in place during the placement of concrete 36 and is removed when the concrete form boards 56 are removed.

Figure 8:
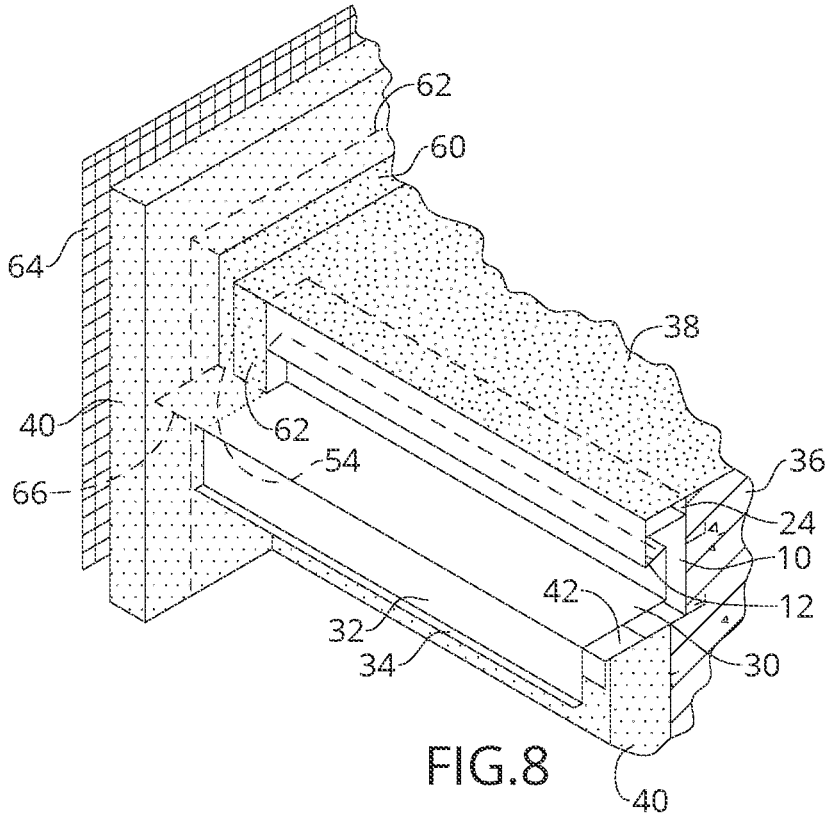
FIG. 8 is a perspective view of the reglet component and the counterflashing component thereof, shown in use against a wall.

FIG. 8 is a perspective view of a slab edge with embedded extrusion 100 and an adjacent exterior wall 64. The snap in flashing 200 is coped at the end to create a tab of flashing 66 which seals the inside corner 54 where stucco 40 and a waterproofing system on a vertical face of wall 60 and a waterproofing system on a vertical face of slab edge 62 intersect.

Figure 9:
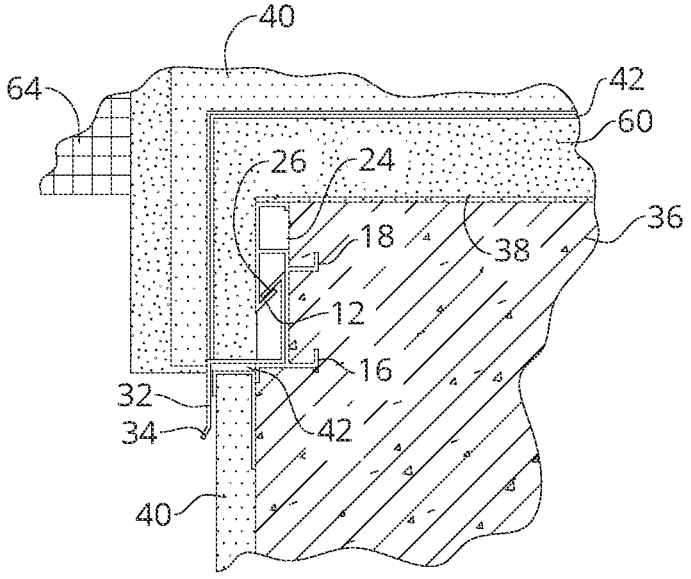
FIG. 9 is a side view thereof, shown in use against the wall.

FIG. 9 is a side view thereof.

It should be understood, of course, that the foregoing relates to exemplary embodiments of the invention and that modifications may be made without departing from the spirit and scope of the invention as set forth in the following claims.

What is claimed is:

1. A flashing system, comprising:
- a unitary reglet having a cross-section including:
  - a central shaft with
    - a substantially C-shaped channel formed at a first end thereof, having a leg extending in a first direction perpendicular to the central shaft, the substantially C-shaped channel forming a sealant pocket;
    - a receiver descending parallel to the central shaft; and
    - a first L-shaped portion formed at a second end of the central shaft, having a first stem extending perpendicularly therefrom; and
- a unitary counterflashing having a cross-section including:
  - a central bar having a first right angle at a first end thereof and a second right angle opposite the first right angle at a second end thereof,
  - a first wall extending from the first right angle with a tip bent at an acute angle to form a top clip, and
  - a second wall extending from the second right angle with a tip bent at an obtuse angle to form a drip edge;
- wherein the unitary counterflashing is operative to engage the unitary reglet.

2. The flashing system of claim 1, wherein the receiver has a resilient end bent at an acute angle into an area between the receiver and the central shaft.

3. The flashing system of claim 1, wherein the substantially C-shaped channel has at least one right angle.

4. The flashing system of claim 1, further comprising a concrete form support, having an asymmetric, substantially T-shaped frame with at least one protrusion operative to engage the unitary reglet.

5. The flashing system of claim 1, further comprising a waterproofing sealant pre-installed within the substantially C-shaped channel of the unitary reglet.

6. The flashing system of claim 1, further comprising at least one prefabricated outside corner flashing component.

7. The flashing system of claim 1, further comprising at least one prefabricated inside corner flashing component.

8. The flashing system of claim 1, further comprising at least one anchor extending from the unitary reglet opposite the first L-shaped portion.

9. A method of installing a flashing system, comprising:
- providing the flashing system of claim 4;
- mounting the concrete form support onto a vertical element of a concrete form;
- engaging the unitary reglet with the concrete form support;
- pouring concrete;
- drying the concrete;
- removing the concrete form and the concrete form support; and
- urging the top clip of the unitary counterflashing into a region defined by the receiver and the central shaft until the unitary counterflashing snaps into place, with the second wall seated against the central shaft, and the central bar and the first wall seated against the first L-shaped portion.

10. The method of claim 9, further comprising applying a stucco veneer to the concrete prior to urging the top clip of the counterflashing into the region.

* * * * *